US005971766A

United States Patent [19]

Guiney

[11] Patent Number: 5,971,766

[45] Date of Patent: Oct. 26, 1999

[54] GOLF TEACHING AID USING FIXED MARKINGS FOR REFERENCE LINE LOCATIONS

[76] Inventor: Edwin W. Guiney, 1885 Central Ave., Needham, Mass. 02492

[21] Appl. No.: 09/173,310

[22] Filed: Oct. 15, 1998

[51] Int. Cl.[6] ..... A63B 69/36

[52] U.S. Cl. ..... 434/252; 473/267; 473/271; 473/278

[58] Field of Search ..... 434/252, 247; 473/267, 266, 269, 270, 271, 218, 278

[56] References Cited

U.S. PATENT DOCUMENTS

| | | | |
|---|---|---|---|
| 4,998,731 | 3/1991 | Bowen | 473/218 |
| 5,071,130 | 12/1991 | Shofner | 473/278 |
| 5,174,566 | 12/1992 | Kelnhofer | 473/267 |
| 5,603,617 | 2/1997 | Light | 434/252 |

*Primary Examiner*—Kien T. Nguyen

[57] ABSTRACT

Fixed markings 20 are a teaching aid made by permanent placing of marks on another teaching aid. Golf lessons are frequently given with the assistance of teaching aids. Teaching aids are used by the golf professional 30 to point out to the golfer 26 many of the factors and positions involved with the golf swing. One of these teaching aids is a full length mirror 10 used to visualize the golfer 26. The mirror is held in a frame 12. The other teaching aid is reference lines 16. Reference lines 16 are best described as cords by which the professional is able to locate different positions of the golfer on the mirror. Reference lines 16 are held in place over the mirror by clips 18 on the ends of the reference lines 16. The clips 18 are attached to the mirror frame 12 over or in between the fixed markings 20. Fixed markings have been permanently placed around the front of the entire perimeter of the mirror frame 12. Fixed markings can be numbers and letters. The numbers and letters around the perimeter of the frame are about ¾" high. There is about 1½" between the fixed markings. Letters identify the sides of the frame: T-top, B-bottom, L-left, R-right of frame. The position of the clips 18 on the frame 12 in between or over the numbers and the side location of letters can be recorded. Recorded clip positions give the reference line 16 position over the mirror 10. Without the fixed markings teaching aid there is no way to record golf lessons given using the other two teaching aids. By using fixed markings golf teaching aid a permanent record FIG. 3C can be made and written down.

7 Claims, 14 Drawing Sheets

| |
|---|
| FIG 4 Front Facing-Shoulders-L5-6, R4 |
| FIG 5 Front Facing-Top of Swing-L2, R2 |
| FIG 6 Front Facing-Left Side Alignment-T7, B7 |
| FIG 7 Left Side Facing-Putting-T8-9, B8-9 |
| FIG 8 Left Side Facing-Left Arm Top of Swing-T1, R9-10 |
| FIG 9 Left Side Facing-Spine Angle-T8, LL |
| FIG 10C Left Side Facing-Swing Plane-L8, R17 |
| |
| |

FIG. 3C

GOLF TEACHING AID USING FIXED MARKINGS FOR REFERENCE LINE LOCATIONS

BACKGROUND—FIELD OF INVENTION

This invention relates to teaching golf, specifically by adding a new dimension to older teaching aids.

BACKGROUND—DESCRIPTION OF PRIOR ART

Golf lessons are frequently given with the assistance of many different types of teaching aids. These teaching aids are used by the golf teacher to point out to the student golfer or golfer many of the factors and positions involved with the golf swing. One of these teaching aids is a full length mirror to visualize the golfer. The mirror is held in a mirror frame. The other teaching aid is reference lines used to visualize the golfers position on the mirror.

Once the golf lesson is over, the golfer has no permanent record of these factors or positions given during the lesson. This fact is an irreplaceable loss to the golfer using these teaching aids by themselves. Fixed markings teaching aid eliminates this loss by adding a permanent recording capability to the two older teaching aids. There are no previous attempts to solve this problem.

OBJECTS AND ADVANTAGES

Accordingly, besides the objects and advantages of the fixed marking system described above in my patent, several objects and advantages are:

(a) provides a way to make a permanent record of golf lessons.

(b) the permanent record can be kept by writing the positions on a piece of paper.

(c) the permanent record can be used at a later date whenever and wherever the golf student wishes to review and practice earlier golf lessons.

(d) provides the ability to be used year-round at home and indoors in other areas.

(e) there are no physical limitations to the golfer for such things as height, weight, age, flexibility, or disability.

(f) there is no limitation to the number of times the invention can be used.

(g) the older teaching aids without the fixed marking system cannot provide accurate complete recall of a golf lesson given days, weeks, or months earlier.

(h) provides flexibility for differences in height, weight, age, physical flexibility and disability.

(i) provides the golf professional with unlimited ways to show and record various factors and positions involved teaching golf.

(j) provides ease of use.

(k) design provides ease of construction.

(l) design provides inexpensive construction.

Still further objects and advantages will become apparent from a consideration of the ensuing description and drawings.

BRIEF DESCRIPTION OF THE DRAWINGS

In drawings, closely related figures have the same number but different alphabetic suffixes.

FIG. 3C shows the chart with writing.

FIG. 5 through FIGS 10A and 10C show the mirror with the golfer and reference lines in different positions with each separate figure. The frame, clips and fixed markings are seen in each figure.

REFERENCE NUMERALS IN DRAWINGS

| | |
|---|---|
| 10 mirror | 12 mirror frame |
| 14 stand | 16 reference lines |
| 18 clips | 20 fixed markings |
| 26 golfer | 30 professional |
| 32 golf club | 34 golf ball |
| 36 putter | |

SUMMARY

Fixed markings are a new golf teaching aid that provide a way to permanently record golf lessons given while using a mirror, mirror frame and reference lines. A permanent record is accomplished by adding fixed markings to the mirror frame in accordance with the present invention.

DESCRIPTION OF INVENTION—FIG. 1 to FIG. 10

Figure 1A:
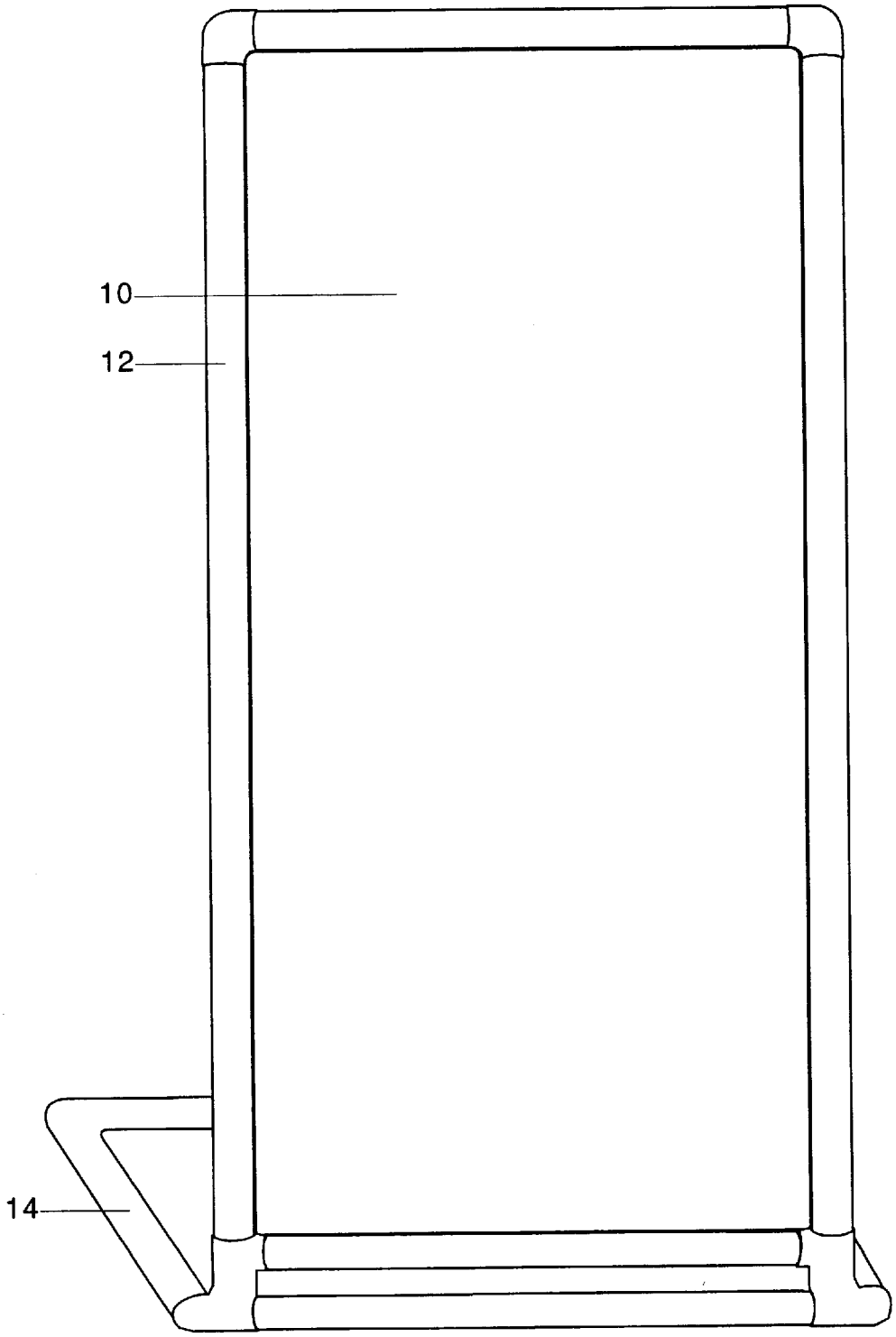
FIG. 1A shows a mirror in a mirror frame with a supporting stand.
Figure 1C:
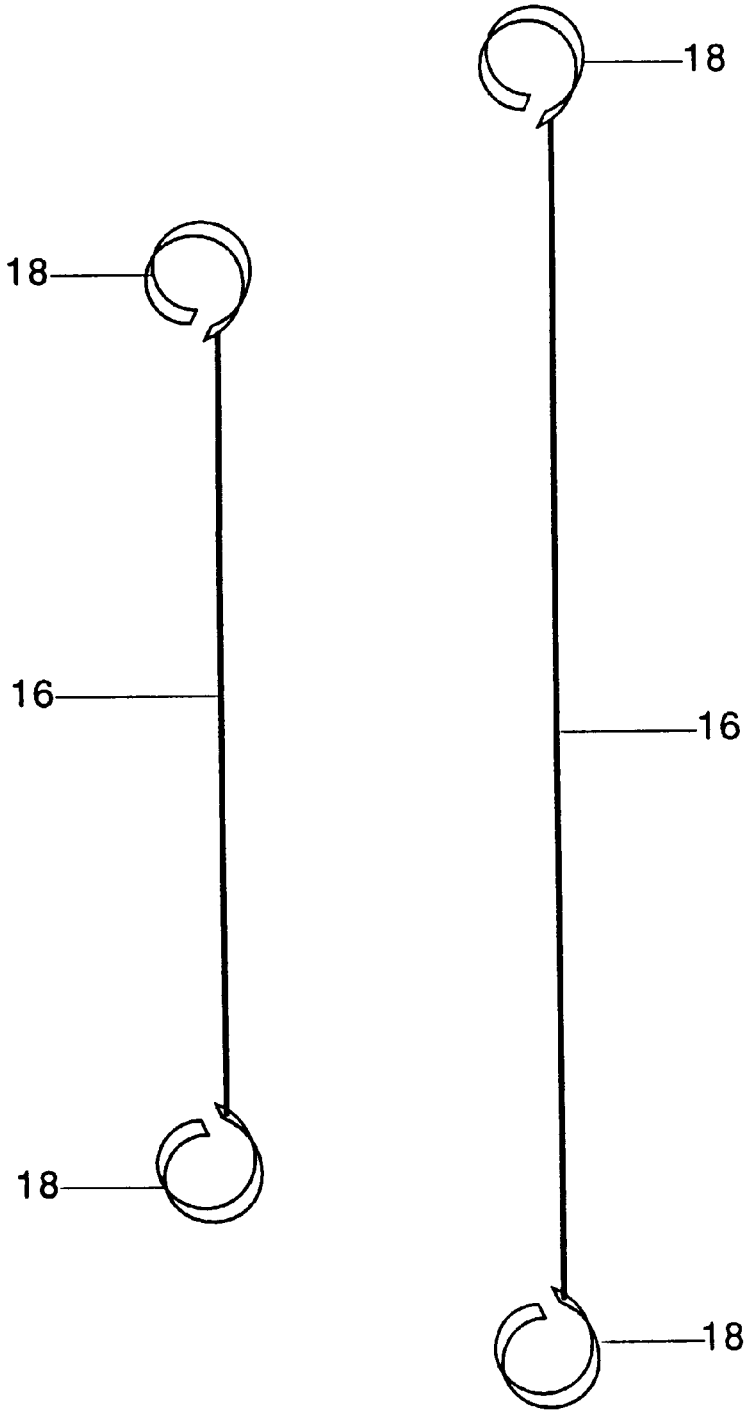
FIG. 1C shows reference lines which include end clips.
Figure 4:
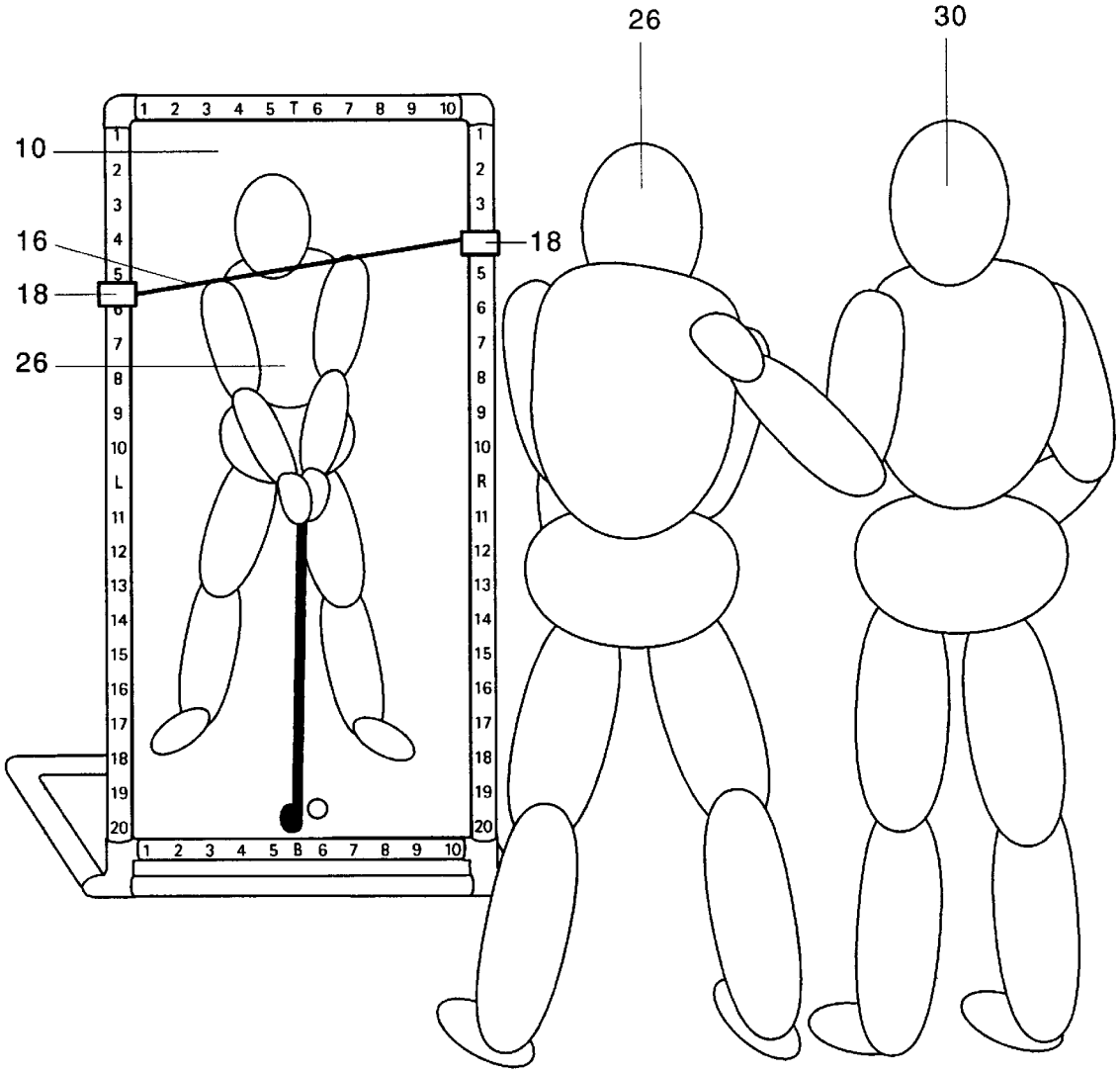
FIG. 4 shows the golf professional, the golfer, the mirror and a reference line in place with the clips over the fixed markings on the frame.

Before describing the embodiment of the present invention, FIG. 1A and FIG. 1C must be described. FIG. 1A and FIG. 1C describe two teaching aids that are commonly used by golf teachers or golf professionals to give golf lessons. One teaching aid is a mirror 10, mirror frame 12 and stand 14 shown in FIG. 1A. The second teaching aid is reference lines 16 and clips 18 in FIG. 1C. A reference line is best described as a cord by which the golf professional is able to locate different positions of the golfer on the mirror during the golf lesson. FIG. 4 will show this later. A golf teaching aid is best described as an object used to assist giving golf lessons.

FIG. 1A shows a mirror 10. The mirror is held by a mirror frame 12. The frame is supported by a stand 14. The mirror size is approximately 2' wide by 4' tall. The frame 12 and stand 14 are made of plastic. The mirror 10 is made of acrylic or glass. Everything shown in FIG. 1A is available commercially.

FIG. 1C shows two reference lines 16 with clips 18 on either end. Reference lines 16 are made of elastic material. The clips 18 are made of plastic. Reference lines 16 vary in length from about 2' to 4'. Everything shown in FIG. 1C is available commercially.

Figure 1D:
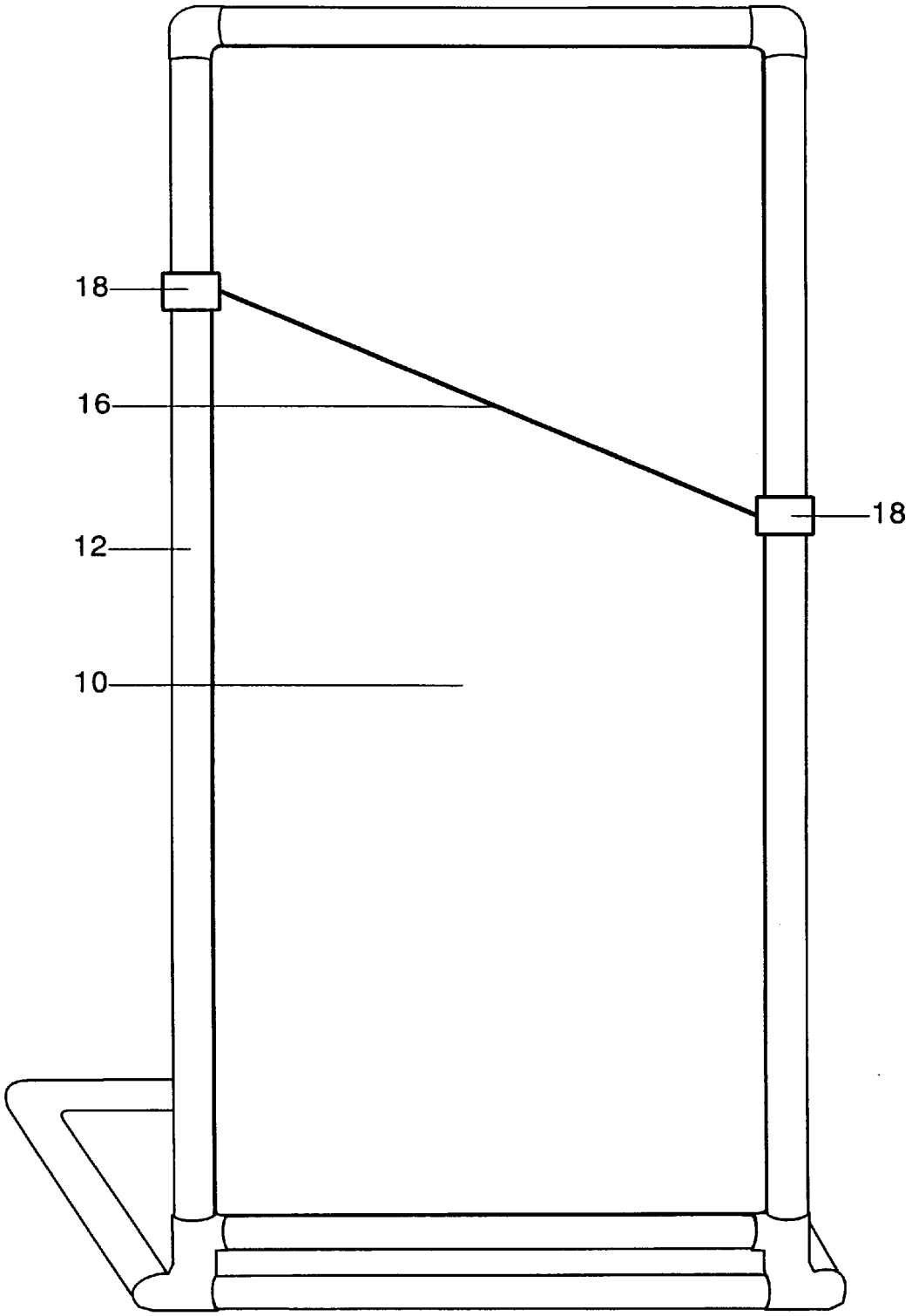
FIG. 1D shows the mirror and frame with reference lines attached to the frame.

FIG. 1D shows the mirror 10, frame 12 and stand 14 and describes how reference lines 16 are positioned on the mirror 10 by clips 18 attached to the frame 12. Positioning the reference lines 16 on the mirror 10 describes how the golf professional uses these teaching aids giving golf lessons.

Figure 2A:
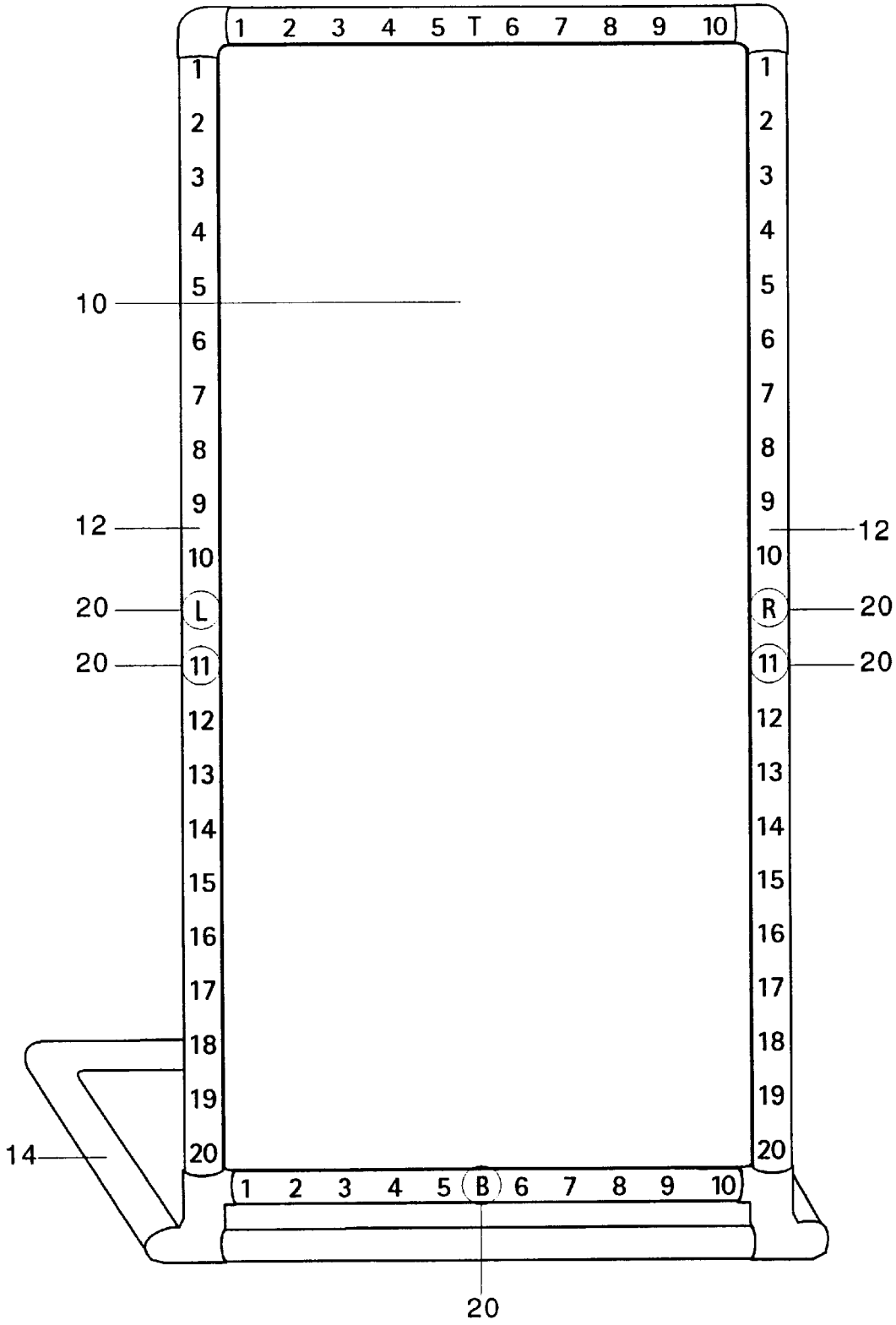
FIG. 2A shows the addition of fixed markings on all four sides of the mirror frame. In this figure the fixed markings used are letters and numbers.
Figure 2C:
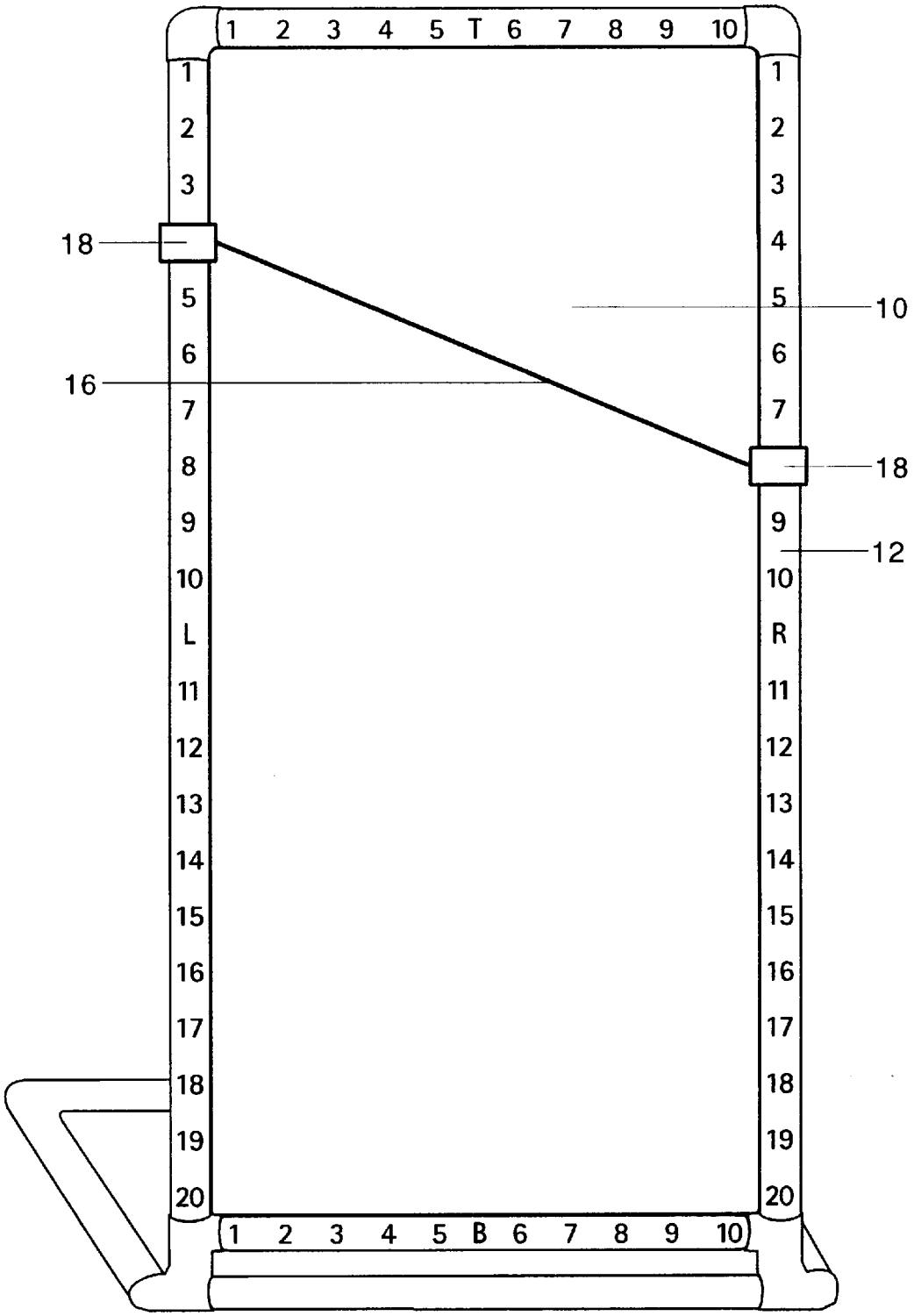
FIG. 2C shows the addition of reference lines and clips attached to the frame over the fixed markings.

The embodiment of the invention is the addition of fixed markings to a mirror frame 12 shown in FIG. 2A and FIG. 2C.

FIG. 2A fixed markings 20 are shown around the front perimeter of the mirror frame 12. Here fixed markings 20 are made up of letters and numbers. The four sides of the frame 12 are identified by letters. The right side by the letter R. The left side by the letter L. The top side by the letter T. The bottom by the letter B. The numbers are shown along the length of the four sides of the frame 12. The numbers start with number one on each side. The markings 20 are about ¾" high and are about 1½" apart on the frame 12. The markings 20 can be applied in many ways such as paint, adhesives, tags, engraving, etc. The markings 20 can be many configurations and colors.

FIG. 2C shows how a reference line 16 is attached to the mirror frame 12 by two clips 18. The clips 18 are now positioned over the numbers on the frame. The clip 18 on the left side of the frame 12 is over #4 on the frame 12. The clip 18 on the right side of the frame 12 is over #8 on the frame 12. The clip positions can now be permanently recorded as L4, R8. The position of the attached reference line 16 over the mirror 10 can be recorded. This result is how fixed markings are used to make a permanent record while using the teaching aids for golf lessons. The position of the clips holding the reference lines can be located in-between the numbers.

Figure 3A:
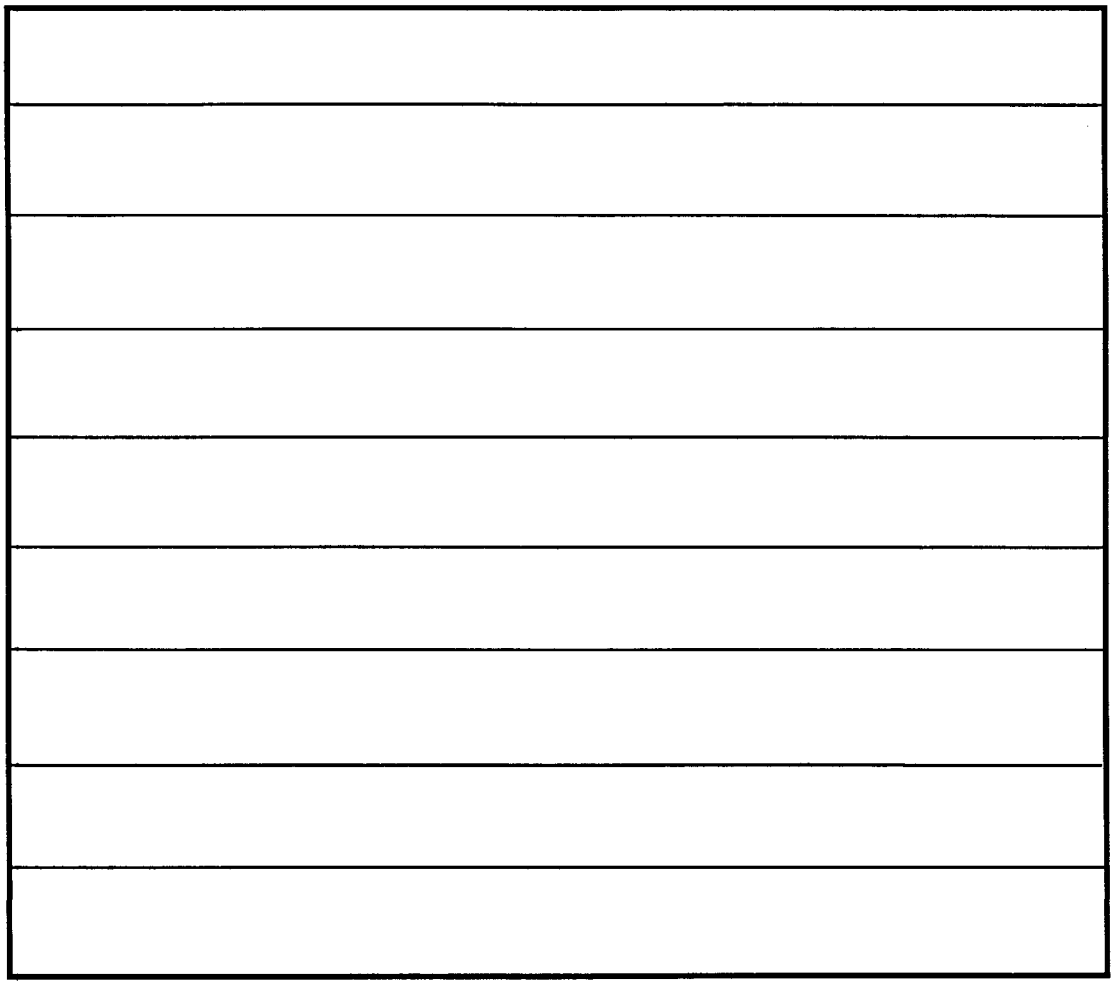
FIG. 3A shows a chart which is blank.

FIG. 3A shows a simple line record chart for recording the position of the golfer in relation to the mirror and the reference line positions. This chart is blank.

FIG. 3C shows the chart with recordings from FIG. 4 to FIG. 10 showing how a permanent record can be kept.

FIG. 4 to FIG. 10 describe some of the factors and positions seen during a golf lesson. The figures describe recordings of these factors and positions using the embodiment of fixed markings teaching aid and the two other teaching aids.

FIG. 4 Shows the golfer 26 facing the mirror 10. The golf professional 30 is shown positioning the golfer's shoulders. The shoulder position is seen in the mirror. The shoulder position is marked on the mirror 10 by the reference line 16 and clips 18. The position of the clips 18 on the left side of the frame would be L5–6. The right side would be R4. Combined record is L5–6, R4.

FIG. 4 The position of the golfer in the mirror 10 must also be recorded. In FIG. 4 the golfer is facing the mirror. For permanent recording purposes the position would be described as FRONT FACING. The position being described in FIG. 4 is the shoulder position. The shoulder position is recorded as SHOULDERS. The permanent record in FIG. 3C would be written FRONT FACING-SHOULDERS-L5–6, R4. FIG. 4 is a comprehensive, selected view of the fixed marking teaching aid.

Each of the next six figures describes one position or function of a golf lesson. The permanent recording of each position or function is described.

Figure 5:
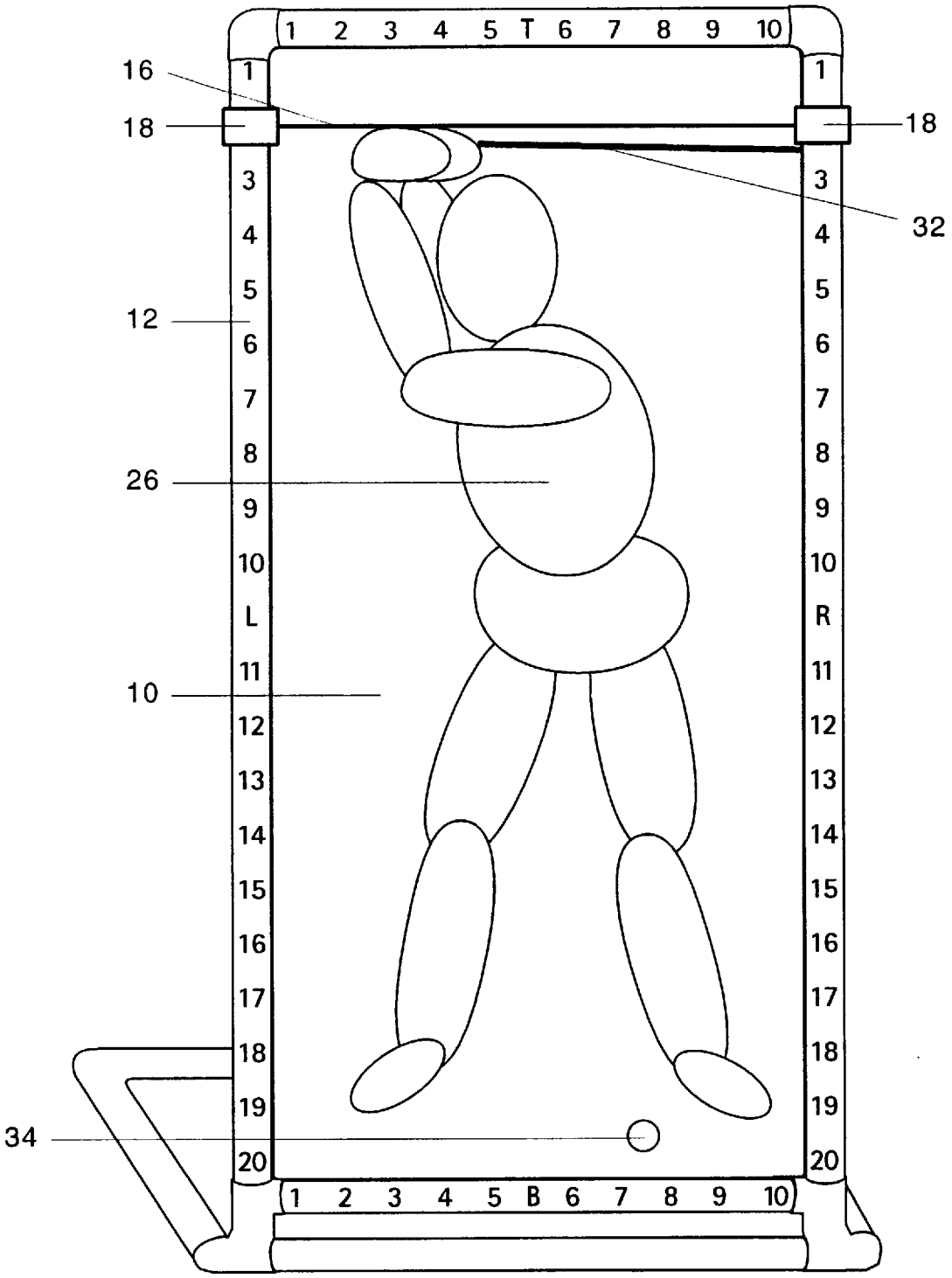

FIG. 5 describes the position of the golfer and the golf club 32 at the top of the backswing. The golfer is facing front. The golf ball is 34. The golf club 32 position is aligned with a reference line 16 over the mirror 10. Reference line 16 is held to the frame 12 by clips 18. The clips 18 are over the fixed markings L2, R2. The permanent record shown on FIG. 3C would be written FRONT FACING-TOP of SWING L2, R2.

Figure 6:
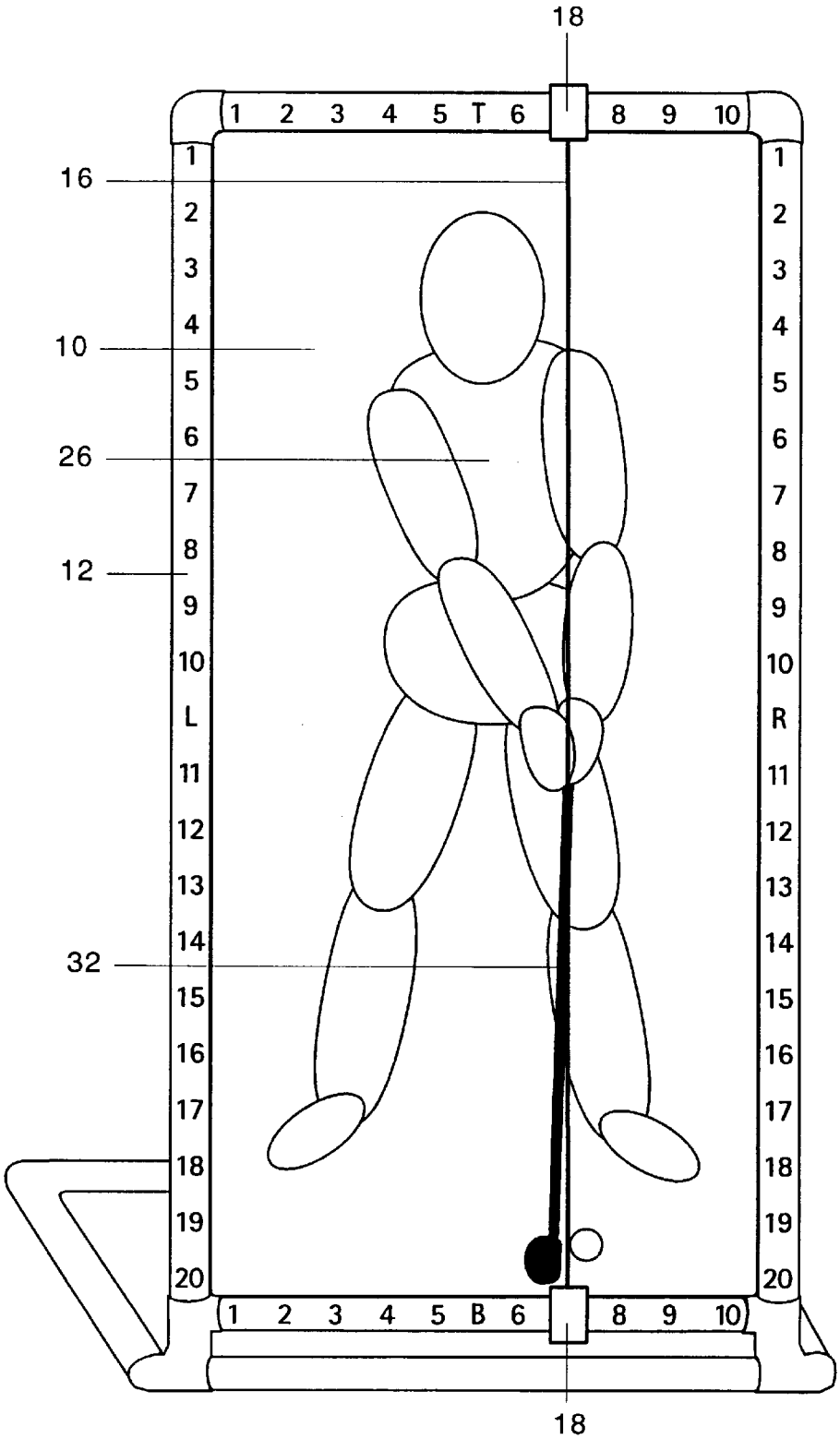

FIG. 6 The golfer 26 is front facing on the mirror 10. Alignment of the golfer's left shoulder, left arm, left hand and left foot are pictured with a golf club 32. The reference line 16 is over the alignment of the golf club with the left shoulder, left arm, left hand and inside left foot. The reference line 16 is held in place by clips 18 on the frame 12. Position of the clips 18 at the top of the frame 12 would be T7. The bottom would be B7. The writing on record chart FIG. 3C would be FRONT FACING-LT SIDE ALIGNMENT T7, B7.

Figure 7:
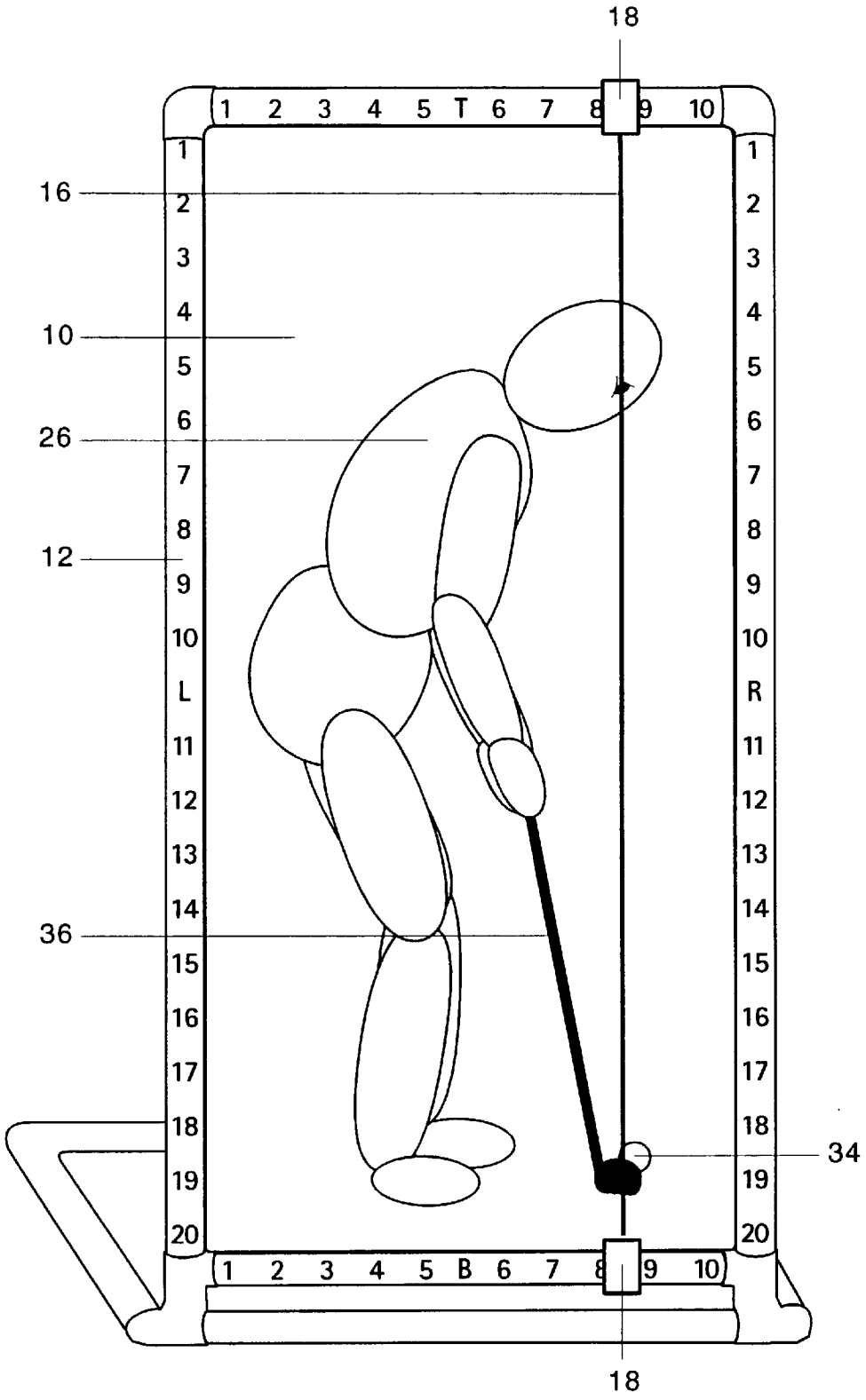

FIG. 7 shows the left side of the golfer 26 facing the mirror 10. A golfer is shown in a position of getting ready to putt a golf ball 34 with a putter 36. The golfer's eyes are lined over the golf ball 34. The reference line 16 shows this alignment. The clips 18 are over T8–9 at the top. The clips are over B8–9 at the bottom. The writing on the record chart in FIG. C3 would be LT S1DE FACING-PUTTING-T8–9, B8–9.

Figure 8:
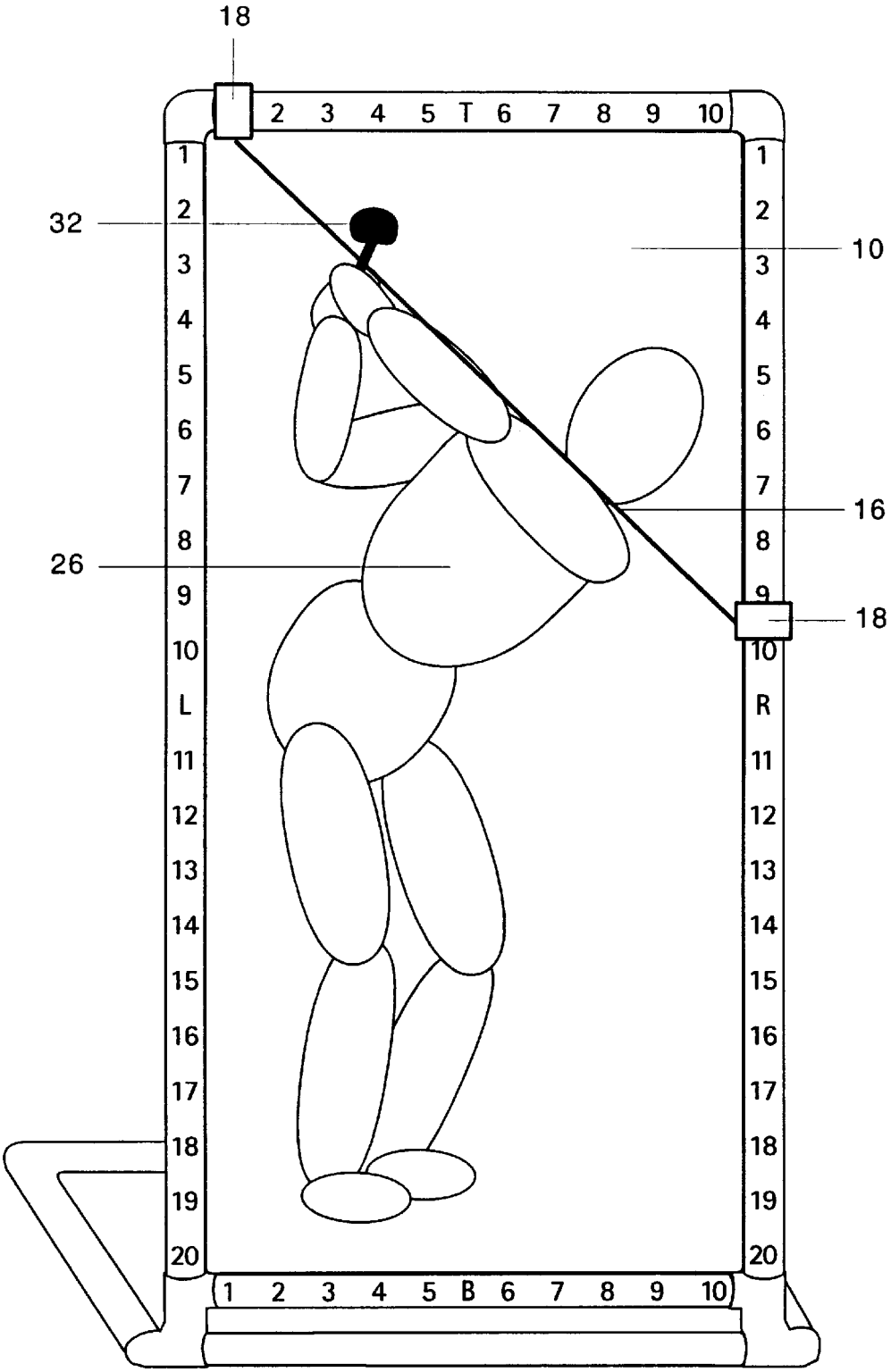

FIG. 8 shows the left side of the golfer 26 facing the mirror. The position of the golfer's left arm, wrist, hand and golf club 32 are shown at the top of the swing. The reference line 16 is aligned with this position. The clip 18 are over T1 and R9–10. Writing on the record chart in FIG. 3C would be LEFT SIDE FACING-LEFT ARM TOP OF SWING T1, R9–10.

Figure 9:
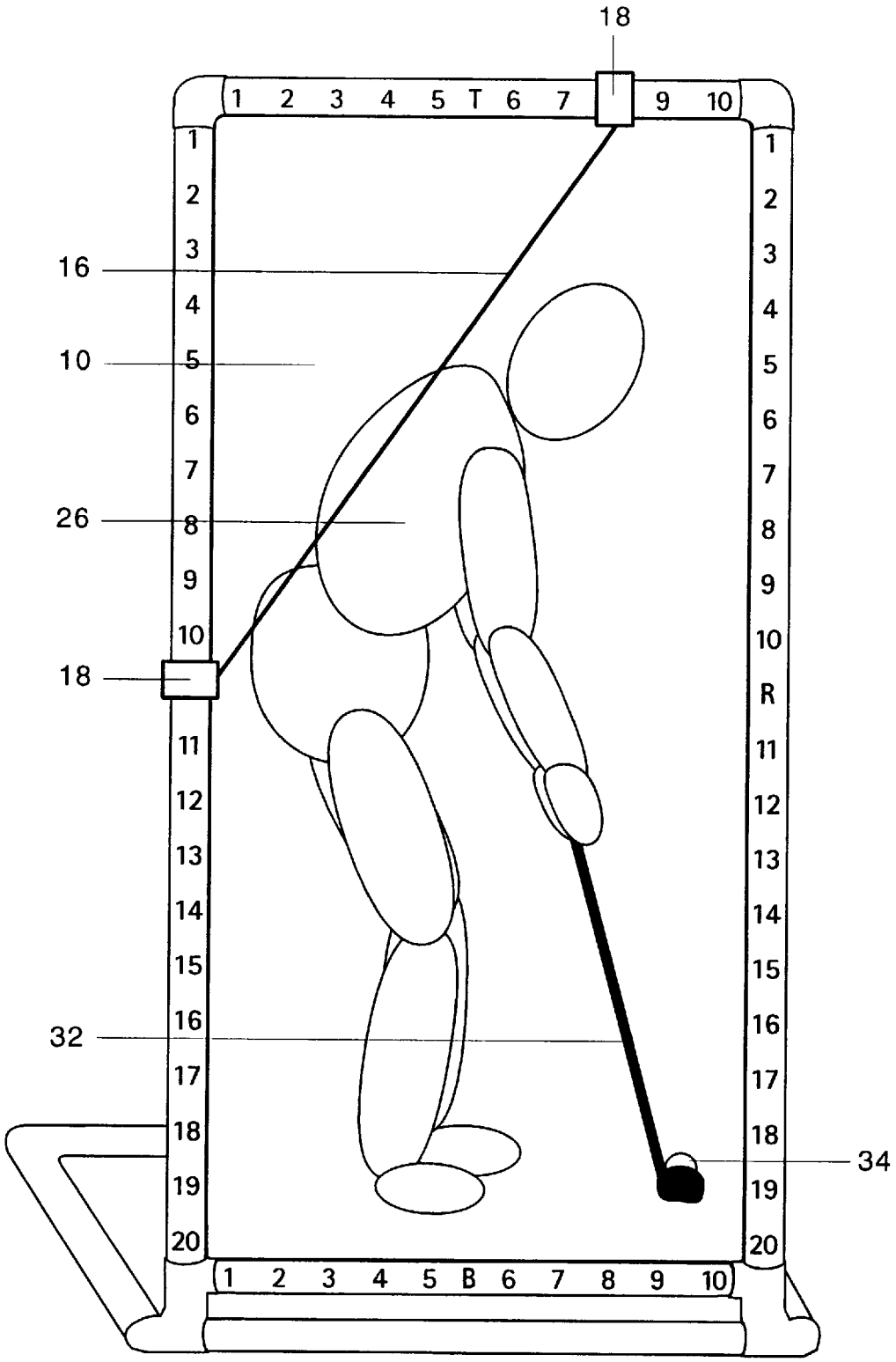

FIG. 9 shows the golfer 26 addressing a golf ball 34 with a golf club 32. The reference line 16 is along the golfer's upper and lower back. This position is called the spine angle. The spine angle is described because it must be maintained during the golf swing. The golfer's left side is facing the mirror 10. The clips are over T8 and L—L. Writing on record chart FIG. 3C would be LEFT SIDE FACING-SPINE ANGLE-T8, L—L.

Figure 10A:
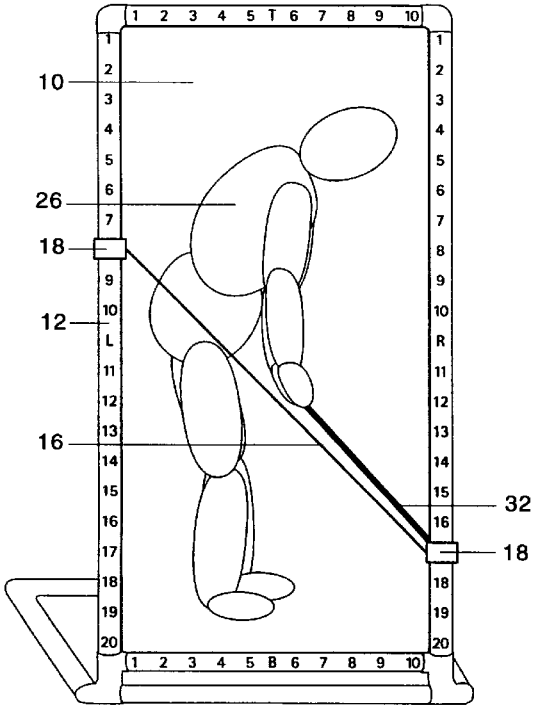

FIG. 10A shows the golfer 26 with the left side facing the mirror 10. The golfer is addressing the golf ball with a golf club 32. The reference line 16 is lined along the golf club and right hand. The line shown by the reference line is called the swing plane. The swing plane is the position to be maintained by the golf club during the first part of the golf swing.

Figure 10C:
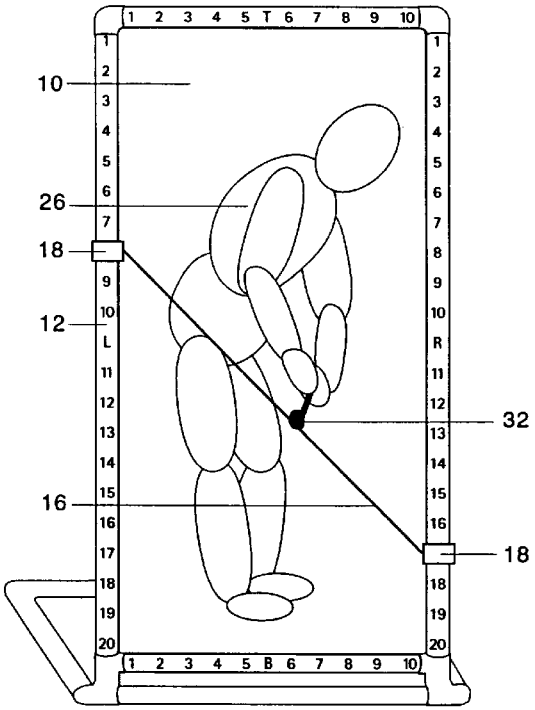

FIG. 10C shows the golfer bringing the golf club 32 back along the swing plane represented by the reference line 16. FIG. 10C describes the use of the swing plane during the golf swing. The clips 18 are over the frame 12 at L8 and R17. Writing on the record chart FIG. 3C would be LEFT SIDE FACING-SWING PLANE L8, R17. From the description above, the advantage of the addition fixed markings as a new teaching aid to two other teaching aids becomes evident. The use of fixed markings permits permanent recordings of golf lessons not previously available.

Operation of Invention

Fixed markings teaching aid is used to make a permanent record of golf lessons given to a golfer by a golf professional using two other golf teaching aids. Teaching aids are objects used to assist teaching. The first teaching aid is a mirror 10, a mirror frame 12, and a frame stand 14 (FIG. 1A). This teaching aid visually shows the golfer's positions and functions related to the golf swing. Reference lines 16 and clips 18 (FIG. 1C) are the second teaching aid. Reference lines are used to mark the position or function the professional is trying to teach the golfer at a particular time. Clips 18 hold the reference lines 16 to the mirror frame 12 during the lesson (FIG. 1D). The two teaching aids are available commercially and they are not patented.

Using these two teaching aids, there is no way to permanently record a golf lesson. The addition of fixed markings 20 to the mirror frame 12 (FIG. 2A) gives a way to permanently record a golf lesson. The fixed markings here are letters and numbers. In FIG. 4 the golf professional 30 is giving the golfer 26 a golf lesson. The professional is positioning the golfer's shoulders. The shoulder position is visualized in the mirror 10. A reference line 16 is placed along the shoulder position and held by clips 18 on the mirror frame 12. The clip 18 on the left side of the frame 12 are over the numbers or the spaces between the numbers. The clip 18 on the left side of the frame 12 is between numbers 5–6. For recording purposes L5–6 would be used to record the position of the clip on the left side. The clip 18 on the right side of the frame 12 is over number 4. For recording purposes R4 would be used for clip on right side. The position of the golfer in the mirror 10 is facing toward the front and would be recorded as FRONT FACING. The lesson being given in FIG. 4 is about shoulder position. The shoulder position would be recorded as SHOULDERS. The permanent record would be written FRONT FACING-SHOULDERS L5–6, R4.

FIG. 3C describes a way positions of the golfer, positions of the reference lines, and positions being taught can be recorded. In FIG. 4 FRONT FACING-SHOULDERS-L5–6, R4 describes the three factors and positions in the lesson depicted in FIG. 4. The golfer now has a simple permanent record of a golf lesson that can be referred to at any time. The golfer can keep this record in a notebook in a convenient place such as a golf bag.

FIG. 5 shows the position of the golf club 32 at the top of the golf swing and position of the reference lines 16 and clip 18 on the frame 12. The left side clip is over number 2. This would be recorded as L2. Right side clip is over number 2. This would be recorded as R2. The golfer is facing front. The permanent record would be FRONT FACING-TOP of SWING-L2, R2 on FIG. 3C.

FIG. 6 to FIG. 10 give additional examples of golf positions and how they are recorded in FIG. 3C using the fixed markings teaching aid.

Positions and functions related to the golf swing available to the professional and the golfer are too numerous to be shown. This is one of the advantages of fixed markings. No matter how many positions and functions are taught they can be permanently recorded.

Conclusions, Ramifications, and Scope of Invention

The reader will see that fixed markings golf teaching aid provides a way to permanently record positions and functions of a golf lesson given, using two other teaching aids. One of the teaching aids is a mirror used to visualize the position of the golfer during the lesson. The second is a reference line to identify on the mirror the position being taught. Once the lesson is finished using these two aids there is no way to permanently record these positions. Lack of a permanent record is a serious loss to the golfer. Furthermore, fixed markings have additional advantages in that:

- they provide the golf professional with multiple ways to show and record various positions and factors involved in teaching golf
- design provides ease of construction and use
- design provides inexpensive construction
- the permanent record can be used at a later date whenever and wherever desired Although the description above contains many specificities, these should not be construed as limiting the scope of the invention but as merely providing illustrations of some of the presently preferred embodiments of this invention. For example, the fixed markings may be letters, numbers, tags, symbols, shapes, etc.. They may be different colors. They may be applied by adhesives, paint, engraving, or built into the frame. Fixed markings can also be applied directly to the mirror or its edges.

Thus, the scope of the invention should be determined by the appended claims and their legal equivalents, rather than by the examples given.

I claim:

1. A golf teaching aid apparatus comprising a frame having a plurality of interconnected frame members;

a mirror surrounded by and fixed to said frame members;

a support stand for supporting said frame members and said mirror;

indicia markings are provided on each of said frame members for indicating the position of a golfer's swing relative to said frame members;

a reference line having a clip at each end thereof for removably attached to said frame members at or between said indicia markings, wherein said reference line providing a marking of different locations of the reflections of the golfer at the beginning and during the swing.

2. An apparatus according to claim 1 wherein said frame is rectangular in shape.

3. An apparatus according to claim 2 further comprising a chart for recording the positions of the golfer's swing by the locations of said clips on or between said indicia markings.

4. An apparatus according to claim 3 wherein said indicia markings are permanently fixed on said frame members.

5. An apparatus according to claim 4 wherein said reference line is flexible.

6. An apparatus according to claim 5 wherein said indicia markings are in numerical numbers and/or alphabet letters.

7. An apparatus according to claim 1 wherein said indicia markings are removably fixed on said frame members.

* * * * *